US010392080B2

(12) United States Patent
O'Rourke et al.

(10) Patent No.: US 10,392,080 B2
(45) Date of Patent: Aug. 27, 2019

(54) BIASED FAIRLEAD CLUMP WEIGHT

(71) Applicants: Charlie O'Rourke, Goleta, CA (US); Bruce Caldwell, Goleta, CA (US)

(72) Inventors: Charlie O'Rourke, Goleta, CA (US); Bruce Caldwell, Goleta, CA (US)

(73) Assignee: Bardex Corporation, Goleta, CA (US)

( * ) Notice: Subject to any disclaimer, the term of this patent is extended or adjusted under 35 U.S.C. 154(b) by 0 days.

(21) Appl. No.: 15/679,105

(22) Filed: Aug. 16, 2017

(65) Prior Publication Data

US 2018/0086421 A1 Mar. 29, 2018

Related U.S. Application Data

(60) Provisional application No. 62/375,817, filed on Aug. 16, 2016.

(51) Int. Cl.
*B63B 21/10* (2006.01)

(52) U.S. Cl.
CPC ..... *B63B 21/10* (2013.01)

(58) Field of Classification Search
CPC ..... B63B 21/10
See application file for complete search history.

(56) References Cited

U.S. PATENT DOCUMENTS 3,397,664 A 8/1968 Slager et al.
5,845,893 A 12/1998 Groves
8,915,205 B2 12/2014 Miller et al.
2013/0116075 A1 5/2013 Miller et al.
2015/0315853 A1* 11/2015 Pollack ..... E21B 17/012 405/224.4
2017/0070132 A1* 3/2017 Wang ..... H02K 33/16

FOREIGN PATENT DOCUMENTS

GB 2069954 A 9/1981

OTHER PUBLICATIONS

Notification of Transmittal of International Search Report and Written Opinion dated Nov. 13, 2017 (issued in PCT Application No. PCT/US2017/047234) [9 pages].

* cited by examiner

*Primary Examiner* — Stephen P Avila
(74) *Attorney, Agent, or Firm* — Michael S. McCoy; Amatong Mccoy LLC

(57) ABSTRACT

A fairlead includes a chain guide support structure and a clump weight engagement member. A clump weight assembly includes a clump weight body, a clump weight coupled to the clump weight body, and a spring housing. The spring housing includes an upper housing wall and at least one spring operatively coupled between the upper housing wall and the clump weight. The clump weight body may be selectively engageable and disengageable with the fairlead to form a fairlead and clump weight assembly. A method of installing and using the clump weight includes engaging the spring housing with the clump weight engagement member, and latching the clump weight body to the clump weight engagement member.

25 Claims, 16 Drawing Sheets

BIASED FAIRLEAD CLUMP WEIGHT

CROSS-REFERENCE TO RELATED APPLICATIONS

The present application claims the benefit of U.S. Provisional Patent Application No. 62/375,817, filed in Aug. 16, 2016, the entirety of which is incorporated herein by reference.

FIELD

The present disclosure relates to clump weights, fairleads, and assemblies thereof, as well as to methods of installation and use thereof.

BACKGROUND

Clump weights are attached to mooring lines to add weight, providing tautness to the mooring lines. Fairleads are used to guide mooring lines on floating vessels.

BRIEF SUMMARY

An embodiment of the present disclosure includes a fairlead and clump weight assembly. The fairlead and clump weight assembly includes a fairlead. The fairlead includes a chain guide support structure and a clump weight engagement member. The fairlead and clump weight assembly includes a clump weight assembly. The clump weight assembly includes a clump weight body, a clump weight coupled to the clump weight body, and a spring housing. At least one spring is operatively coupled between the spring housing and the clump weight. The clump weight body is selectively engageable and disengageable with the fairlead, such as via chain latches on the fairlead or toggle latches on the clump weight assembly.

Another embodiment of the present disclosure includes a fairlead. The fairlead includes a fairlead body. The fairlead body includes a chain guide support structure and a clump weight engagement member. The fairlead includes a chain guide coupled to the chain guide support structure.

Another embodiment of the present disclosure includes a clump weight assembly. The clump weight assembly includes a clump weight body, a clump weight coupled to the clump weight body, and a spring housing. At least one spring is operatively coupled between the spring housing and the clump weight.

Another embodiment of the present disclosure includes a method of installation and use of a clump weight. The method includes providing a fairlead on a floating structure. The fairlead includes a chain guide support structure and a clump weight engagement member. The method includes providing a clump weight assembly. The clump weight assembly includes a clump weight body, a clump weight coupled to the clump weight body, and a spring housing. At least one spring is operatively coupled between the spring housing and the clump weight. The method includes installing the clump weight assembly on the fairlead. Installing the clump weight assembly on the fairlead includes engaging the spring housing with the clump weight engagement member, and latching the clump weight body to the clump weight engagement member, such as via chain latches on the fairlead or toggle latches on the clump weight assembly.

Another embodiment of the present disclosure includes a fairlead and clump weight assembly. The fairlead and clump weight assembly includes a fairlead and a clump weight assembly. The clump weight assembly includes a clump weight and a spring housing. At least one spring is operatively coupled between the spring housing and the clump weight. The clump weight is selectively engageable and disengageable with the fairlead.

The foregoing has outlined rather broadly the features and technical advantages of the present disclosure in order that the detailed description that follows may be better understood. Additional features and advantages will be described hereinafter, which form the subject of the claims. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure. The novel features which are believed to be characteristic of the products, systems, and methods, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

So that the manner in which the features and advantages of the system, products, and/or method so of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Figure 1:
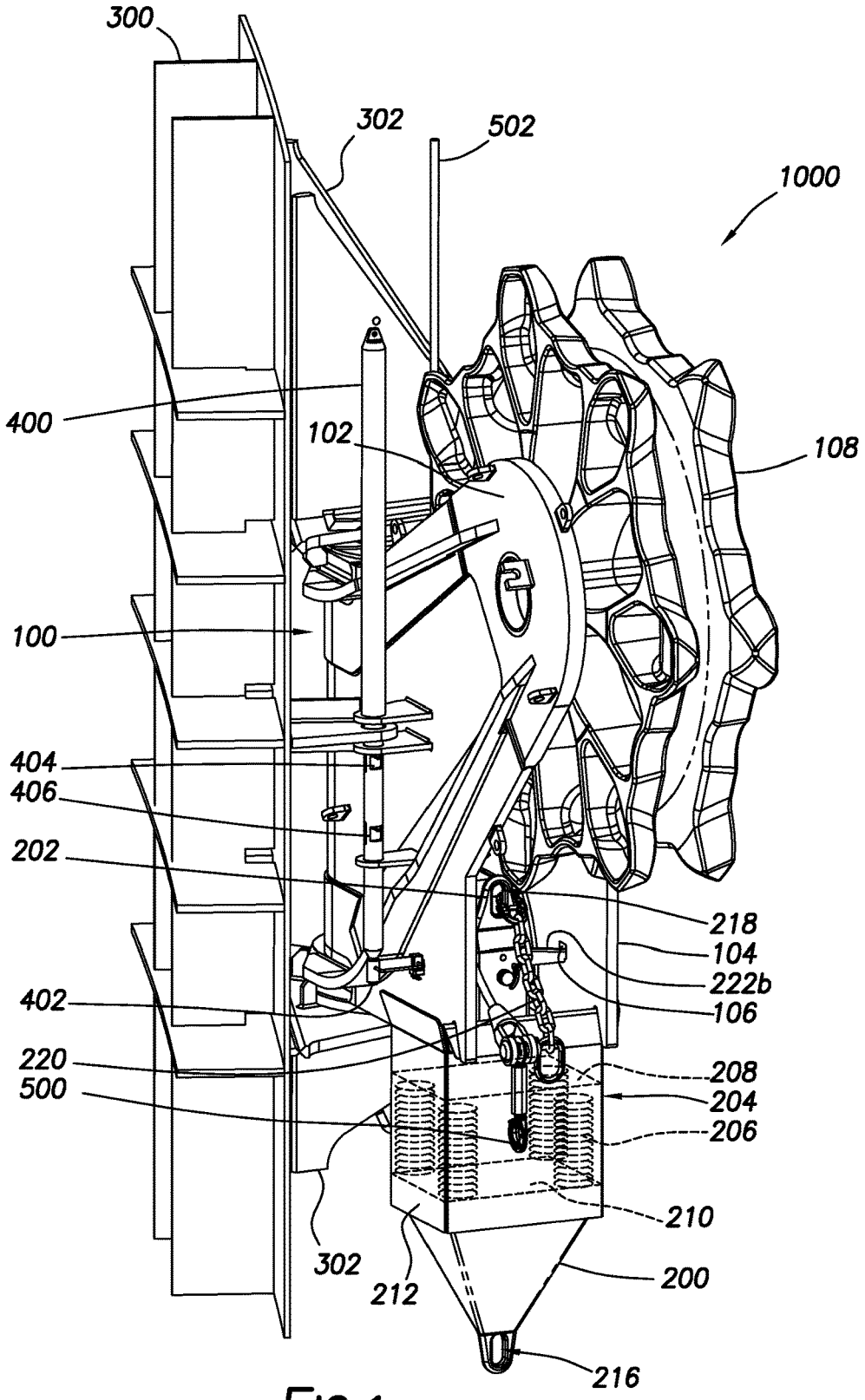
FIG. 1 is a perspective view of a fairlead and clump weight assembly with a messenger wire routed through the fairlead in accordance with certain embodiments.

Products and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain embodiments of the present disclosure include a fairlead, a clump weight, or a fairlead and clump weight assembly. With reference to FIGS. 1-3C, fairlead and clump weight assembly 1000 and portions thereof are depicted. Fairlead and clump weight assembly 1000 includes fairlead 100 and clump weight 200. Fairlead 100 is coupled to a portion of floating structure 300. Floating structure 300 may be, for example and without limitation, an offshore floating platform, a ship, or other floating vessel. In some embodiments, fairlead 100 is movably (e.g., rotatably and/or pivotably) coupled to floating structure 300, between brackets 302.

Fairlead 100 includes a fairlead body composed of chain guide support structure 102 and clump weight engagement member 104.

Chain guide 108 is coupled to chain guide support structure 102. In some embodiments, chain guide 108 is a chain wheel, including but not limited to single or dual chain wheels, such as the chain wheels shown and described in U.S. patent application Ser. No. 13/669,310, the entirety of which is incorporated herein by reference. While chain guide 108 is shown and described as a chain wheel, fairlead and clump weight assembly 1000 is not limited to chain wheels as the chain guide, and may include other chain guides well known to those skilled in the art, such as a bending shoe.

Fairlead 100 also includes toggle latch eyes 106, which are holes extending through clump weight engagement member 104. Each toggle latch eyes 106 is spaced from the bottom of clump weight engagement member 104.

Clump weight 200 may be installed in drydock before submergence of fairlead 100, with or without a messenger wire 502 attached thereto. In some embodiments, operational flexibility is enhanced if the messenger wire 502 is removable for tow operations. Clump weight 200 may be configured to resist corrosion, including self-protection from cathodic corrosion. For example, clump weight 200 may be painted and/or coated with one or more layers that provide cathodic protection thereto. Some embodiments of clump weight 200 may be submerged within water (e.g., ocean water) for more than one year without experiencing substantial corrosion. Clump weight 200 is coupled to clump weight body 202. In some embodiments, clump weight body 202 is an elongated body. Clump weight body 202 may be attached to or integral with clump weight 200. Clump weight 200 includes a connection point, such as lifting eye 216. Clump weight body 202 includes include a connection point, such as lifting eye 218, for attachment to a chain, cable, wire, or the like. For example, lifting eye 218 may be coupled to clump weight chain 220 (clump weight 220 chain lashing not shown, for clarity). Clump weight 200 may have a weight sufficient to lift an anchor chain from a chain locker on floating vessel 300. In some embodiments, clump weight 200 may be configured to be recoverable over a stern roller of floating structure 300.

In some embodiments, clump weight 200 is suspended via one or more springs 206 from spring housing 204. Clump weight 200 is movable relative to spring housing 204, or a portion thereof (e.g., upper housing wall 208). In operation, when clump weight 200 moves towards spring housing 204 (e.g., towards upper housing wall 208), compression of springs 206 increases, and when clump weight 200 moves away from spring housing 204 (e.g., away from upper housing wall 208), compression of springs 206 decreases. As shown in FIG. 1, spring housing 204 is coupled to clump weight body 202. In some embodiments, spring housing 204 is a weldment. Spring housing 204 includes upper housing wall 208, lower housing wall 210, and sidewalls 212. One or more springs 206 are positioned within spring housing 204, between upper and lower housing walls 208 and 210. Each spring 206 is coupled to upper housing wall 208 at one end and to lower housing wall 210 at the opposite end, extending there-between. In some embodiments, lower housing wall 210 is a portion of clump weight 200, such as a top surface thereof. As such, clump weight 200 is operatively coupled to upper housing wall 208 via springs 206, such that clump weight 200 is movable toward and away from upper housing wall 208 with compression and extension of springs 206, respectively. In some embodiments, upper housing wall 208 is movable with respect to lower housing wall 210, and springs 206 compress when upper housing wall 208 and lower housing wall 210 move toward one another. Springs 206 may have sufficient spring tension to secure clump weight 200 in position. In some embodiments, each spring 206 is, or all springs combined are, configured to provide a compressive force of at least 1 metric ton. For example and without limitation, each spring 206, or all springs combined, may be configured to provide a compressive force ranging from 1 metric ton to 10 metric tons, or from 2 metric tons to 8 metric tons, or from 3 metric tons to 7 metric tons, or from 4 metric tons to 6 metric tons, or 5 metric tons.

In some embodiments, clump weight engagement member 104, or a bottom portion thereof, is sized and/or shaped to engage with spring housing 204, or at least the upper portion thereof. For example, as shown in FIG. 2, clump weight engagement member 104 includes engagement recesses 110 configured (e.g., sized and/or shaped) to receive a portion of spring housing 204, spring housing engagement portion 214.

Figure 4A:
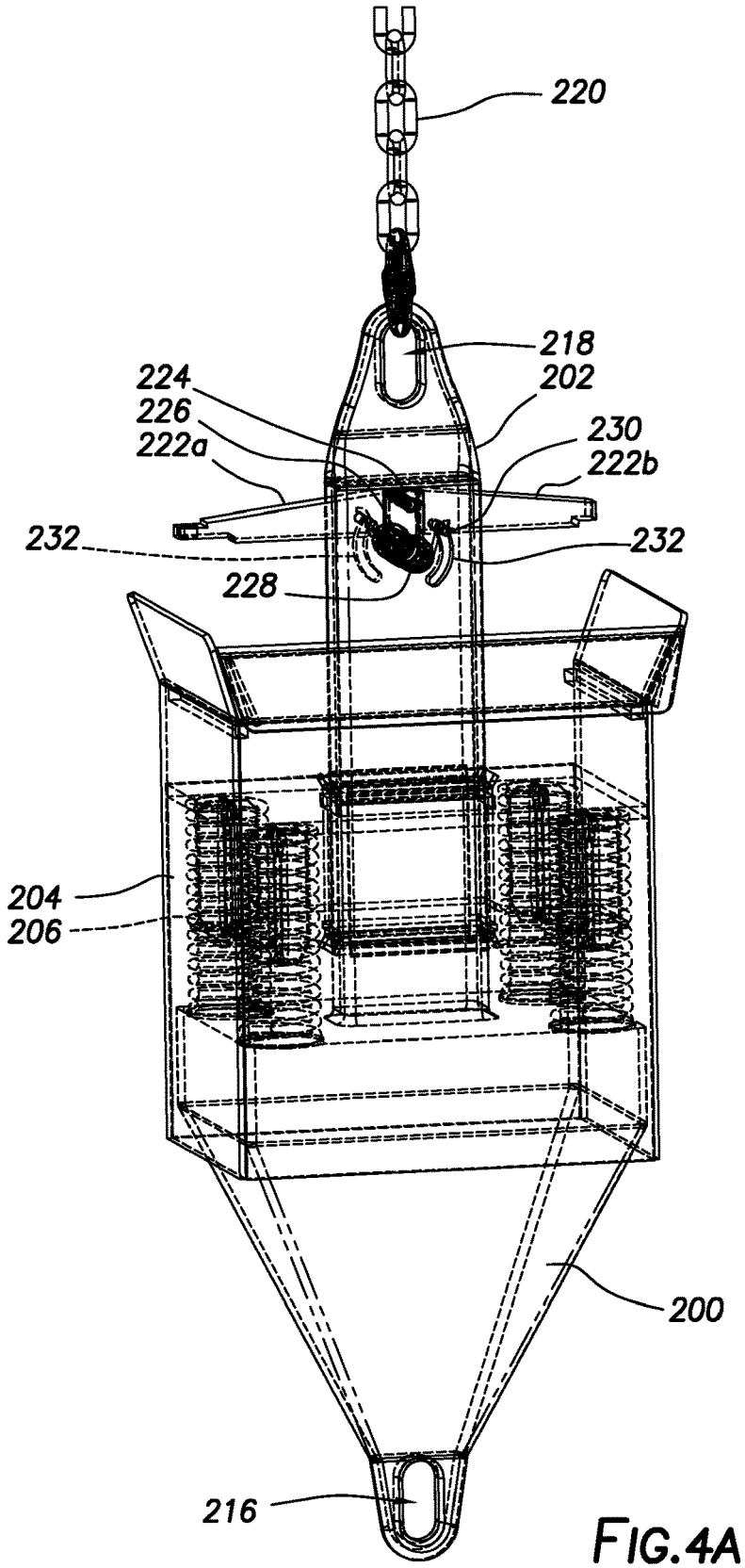
FIGS. 4A-4C are perspective views of a clump weight assembly and portions thereof in accordance with certain embodiments.
Figure 4B:
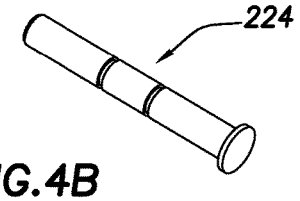
Figure 4C:
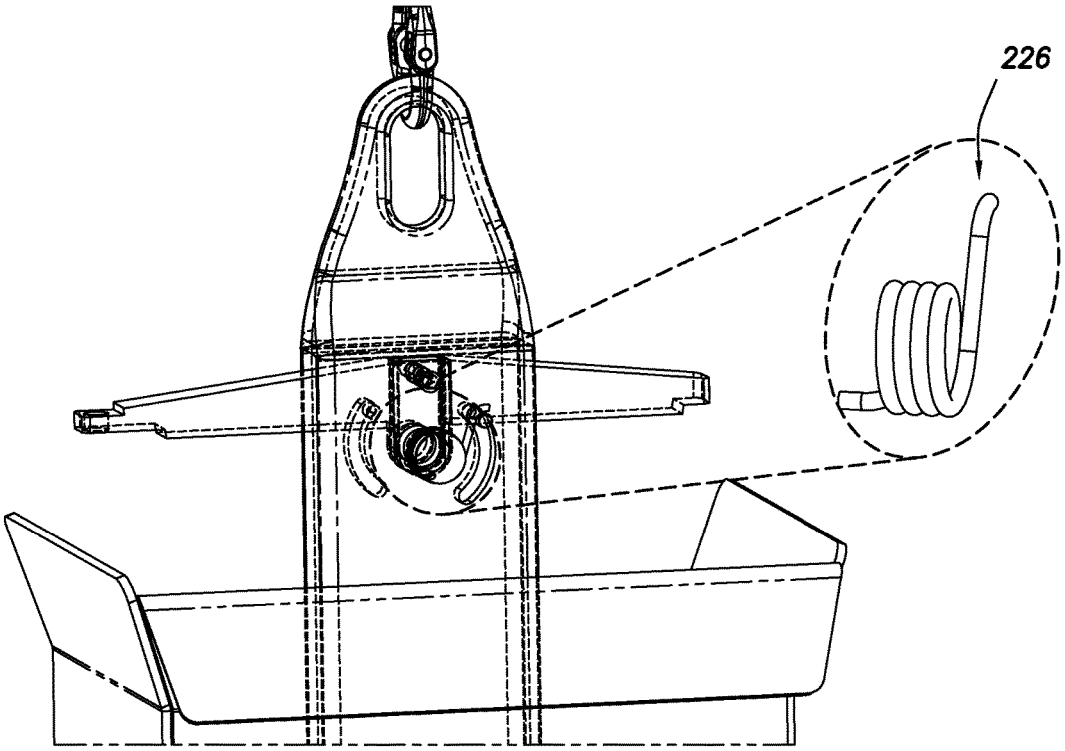

With reference to FIGS. 4A-4C, toggle latches 222*a* and 222*b* are movably (e.g., pivotably and/or rotatably) connected to clump weight body 202. In FIG. 4A, toggle latches 222*a* and 222*b* are shown in the open configuration, with toggle latches 222*a* and 222*b* extending outward from clump weight body 202. First toggle latch 222*a* and second toggle latch 222*b* are each connected to clump weight body 202. First and second toggle latches 222*a* and 222*b* are configured to rotate with respect to clump weight body 202 and with respect to each other. Toggle latches 222*a* and 222*b* are maintained in the open configuration, at least in part, via shear pin 224, engaged therewith. When engaged with toggle latches 222*a* and 222*b*, shear pin 224 limits the movement of toggle latches 222*a* and 222*b* relative to clump weight body 202, resisting premature release and/or rotation of toggle latches 222*a* and 222*b*. Toggle latches 222*a* and 222*b* are configured to move relative to clump weight body 202 when shear pin 224 is removed from engagement with toggle latches 222*a* and 222*b*.

Torsion spring 226 is engaged to clump weight body 202. As shown in the embodiment of FIG. 4A, pivot pin 228 extends outwardly from a surface of clump weight body 202. Toggle latches 222*a* and 222*b* and torsion spring 226 are each engaged on pivot pin 228. Torsion spring 226 is also engaged to toggle latches 222 via torsion spring engagement pin 230. Toggle latches 222*a* and 222*b* are movable from a position of horizontal alignment (as shown), downwardly to a position of vertical alignment against clump weight body 202. When shear pin 224 is sheared or is otherwise disengaged from toggle latches 222*a* and 222*b*, torsion spring 226 biases first and second toggle latches 222*a* and 222*b* to rotate downwards, and into alignment with and against clump weight body 202. Toggle latches 222*a* and 222*b* are engaged with tracks 232, such as via torsion spring engagement pin 230 or via a portion of toggle latches 222*a* and 222*b* extending into tracks 232. As such, when toggle latches 222*a* and 222*b* move downwards and into alignment with clump weight body 202, toggle latches 222*a* and 222*b* move along tracks 232. Thus, the endpoints of tracks 232 define the maximum downwards rotation available to toggle latches 222*a* and 222*b*, preventing movement of toggle latches 222*a* and 222*b* there-beyond. From the open configuration, toggle latches 222*a* and 222*b* are configured such that toggle latches 222*a* and 222*b* are prevented from moving (e.g., pivoting and/or rotating) upwards (i.e., towards lifting eye 218 in the embodiment shown in FIG. 4A). Prevention of movement of toggle latches 222*a* and 222*b* upwards may be accomplished via biasing from torsion spring 226, endpoints of tracks 232 defining the range of motion for toggle latches 222*a* and 222*b*, gravity, or combinations thereof.

Figure 2:
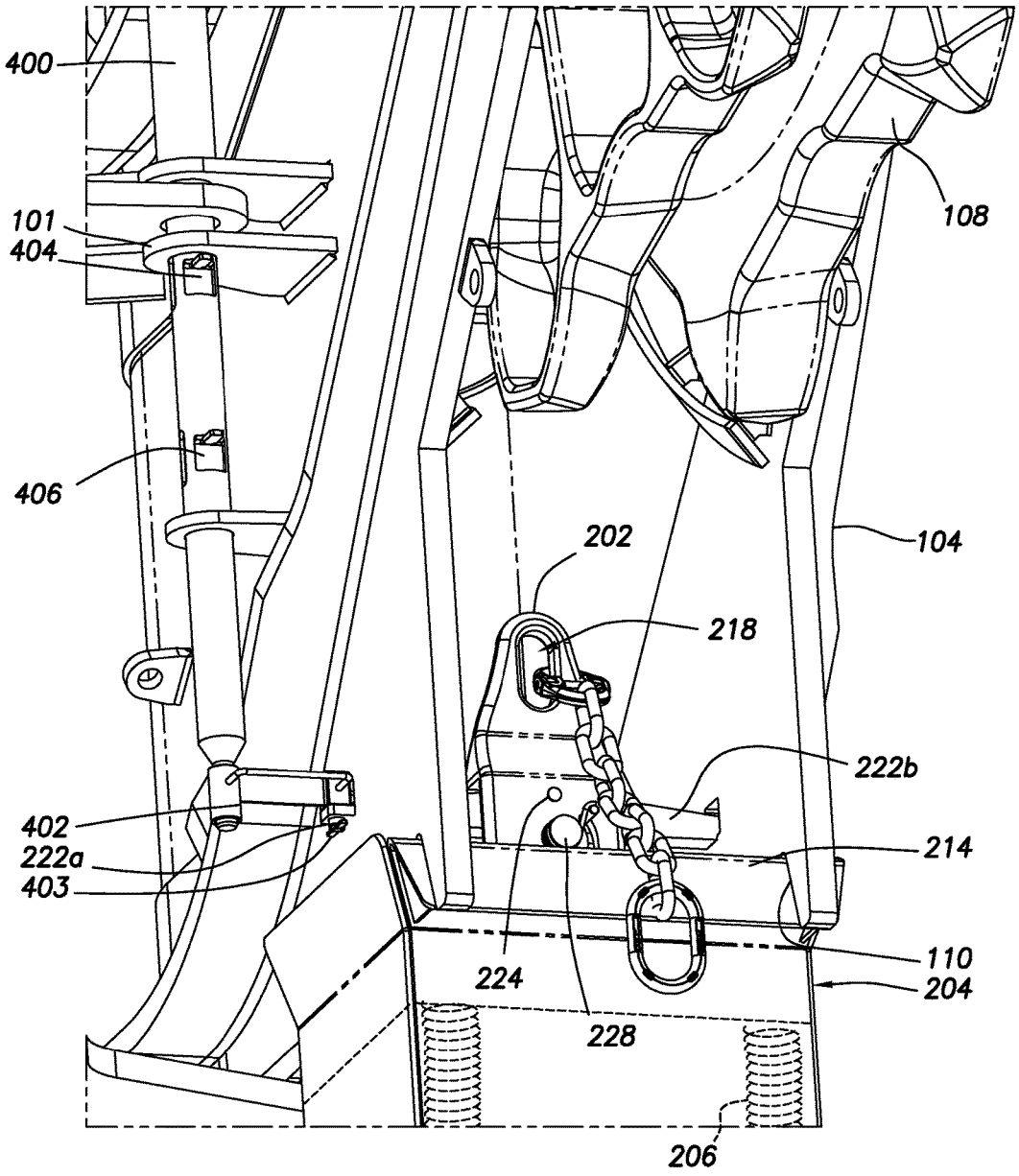
FIG. 2 is a perspective view of a portion of the fairlead and clump weight assembly showing a sea-fastening pin and toggle latch assembly thereof in accordance with certain embodiments.
Figure 3A:
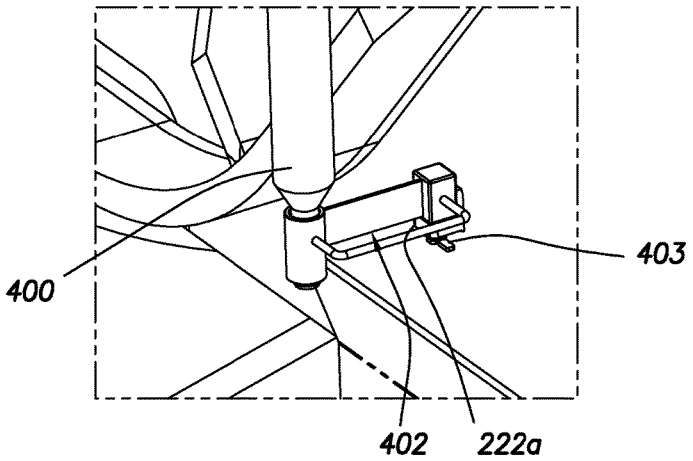
FIGS. 3A-3C are perspective views of portions of the fairlead and clump weight assembly showing a toggle latch interlock thereof in accordance with certain embodiments.
Figure 3B:
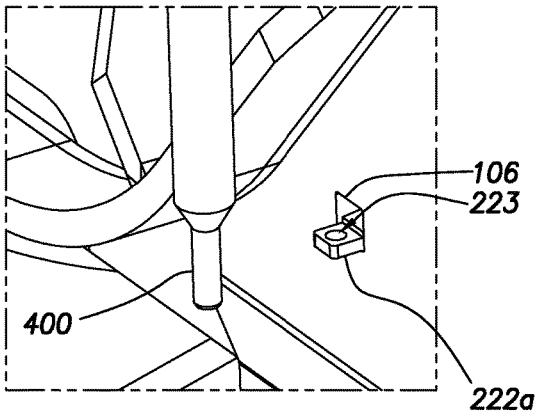
Figure 3C:
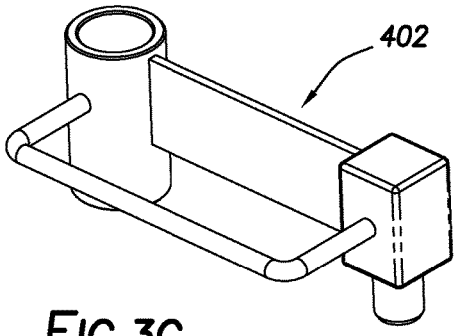

With further reference to FIGS. 1-3C, fairlead and clump weight assembly 1000 includes sea-fastening pin 400. Sea fastening pin 400 is movably connected to fairlead 100. Sea-fastening pin 400 includes upper sea-fastening pin keeper 404 and lower sea fastening pin keeper 406. Upper and lower sea-fastening pin keepers 404 and 406 are operable to selectively maintain a position of sea-fastening pin 400 relative to fairlead 100. For example, upper sea-fastening pin keeper 404 is shown in FIG. 2 in a locked configuration. In the locked configuration of upper sea-fastening pin keeper 404, upper sea-fastening pin keeper 404 is engaged with a portion of fairlead 100, fairlead bracket 101, preventing movement of sea-fastening pin 400. Upper sea-fastening pin keeper 404 is movable into an unlocked configuration, such that upper sea-fastening pin keeper 404 is no longer engaged with fairlead bracket 101, allowing sea-fastening pin 400 to be moved relative to fairlead 100 to disengage sea-fastening pin 400 from toggle interlock 402. Lower sea-fastening pin keeper 406 functions in the same manner as upper sea-fastening pin keeper 404 to selectively move between locked and unlocked configurations.

Toggle interlock 402 is removably connected to and between sea fastening pin 400 and toggle latch 222*a*. Toggle interlock 402 may be maintained in engagement with toggle latch 222*a* via toggle interlock keeper 403. For example, a portion of toggle interlock 402 may extend through toggle latch throughhole 223 from a topside thereof. Toggle interlock keeper 403 may then be engaged with toggle interlock 402 on a bottom side of toggle latch throughhole 223, retaining toggle interlock 402 in engagement with toggle latch 222*a*.

One of skill in the art would understand that fairlead and clump weight assembly 1000 is not limited to the particular structures and configurations, as shown, and that modifications to the structures and/or arrangements thereof may be made without departing from the spirit or scope of the present disclosure. For example, while retention of engagement between clump weight 200 and fairlead 100 is shown as being achieved via toggle latches 222*a* and 222*b* engaged with clump weight engagement member 104 and sea-fastening pin 400 via toggle interlock 402, one skilled in the art would understand that other structures or combinations of structures could be used to retain engagement between clump weight 200 and fairlead 100. Furthermore, while toggle latches 222*a* and 222*b* are maintained in position via shear pin 224 and biased via torsion spring 226, one skilled in the art would understand that other structures or combinations of structures could be used to achieve the same ends.

FIG. 1 depicts fairlead and clump weight assembly 1000 with a messenger wire 502 positioned in relate to clump weight 200. In some embodiments, fairlead and clump weight assembly 1000 may be arranged into a "tow configuration" without a messenger wire coupled therewith. The tow configuration is a suitable configuration during, for example, towing of floating structure 300. In the tow configuration, clump weight 200 is engaged with fairlead 100, and secured to fairlead 100 by a self-latching mechanism, toggle latches 222*a* and 222*b*, that engages within toggle latch eyes 106. Clump weight 200 is also secured to fairlead 100 and locked in place via a sea-fastening system, including sea-fastening pin 400, pin keepers 404 and 406, toggle interlock 402, and toggle interlock keeper 403. In the tow configuration, both upper sea-fastening pin keeper 404 and lower sea-fastening pin keeper 406 are in the locked configuration, with sea-fastening pin 400 engaged with toggle interlock 402. Toggle interlock 402 is engaged with toggle latch 222*a* and toggle interlock keeper 403. Both toggle latches 222*a* and 222*b* are disposed in the open configuration, with toggle latches 222*a* and 222*b* each extending through toggle latch eyes 106. In the tow configuration, shear pin 224 is not yet sheared, maintaining a position of toggle latches 222*a* and 222*b*. Also, in the tow configuration, springs 206 are partially compressed, preventing movement of clump weight 200 by: (1) applying a downward force to clump weight 200 and toggle latches 222*a* and 222*b*, and (2) applying an upward force to spring housing 204 against fairlead 100. In the tow configuration, with toggle latches 222*a* and 222*b* secured via toggle interlock 402, toggle latches 222*a* and 222*b* are prevented from folding downward until sea-fastening pin 400 is pulled upwards from engagement with toggle interlock 402, and toggle interlock 402 is removed from engagement with toggle latch 222*a*. Pulling sea-fastening pin 400 upwards from engagement with toggle interlock 402, and removing toggle interlock 402 from engagement with toggle latch 222*a* may be accomplished via a diver or a remotely operated vehicle (ROV), for example.

FIG. 1 also depicts fairlead and clump weight assembly 1000 with messenger wire 502 being routed through fairlead 100 to be connected with clump weight 200 via an ROV. For example and without lamination, an ROV may operatively engage with messenger wire 502 via engaging ROV engagement member 500 (e.g., a hook or eye) on messenger wire 502. Messenger wire 502 may be attached to the top of clump weight 200 (e.g., at lifting eye 218) by an ROV, or by a diver. In some embodiments, a cross-haul wire from an anchor handling tug (AHT) may be attached to the bottom of clump weight 200 (e.g., at lifting eye 216) via an ROV or a diver.

Figure 5:
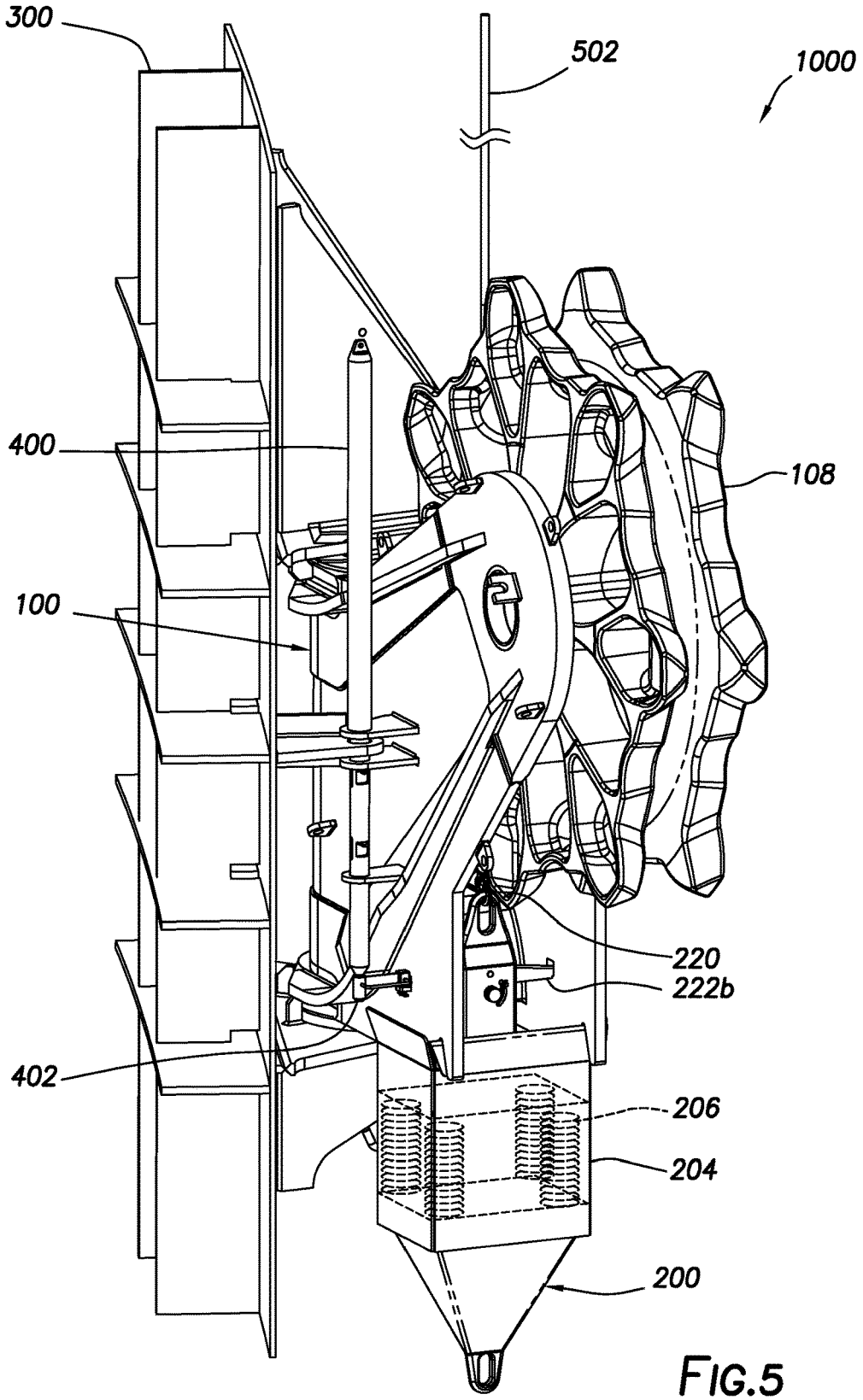
FIG. 5 is a perspective view of the fairlead and clump weight assembly with the messenger wire attached to a clump weight chain in accordance with certain embodiments.

After routing messenger wire 502 through fairlead 100, messenger wire 502 is attached to clump weight chain 220, as shown in FIG. 5. The sea-fastening pin 400, toggle interlock 402, toggle latches 222*a* and 222*b*, and associated components are in the same configurations in FIG. 5 as described with respect to FIG. 1.

Figure 6A:
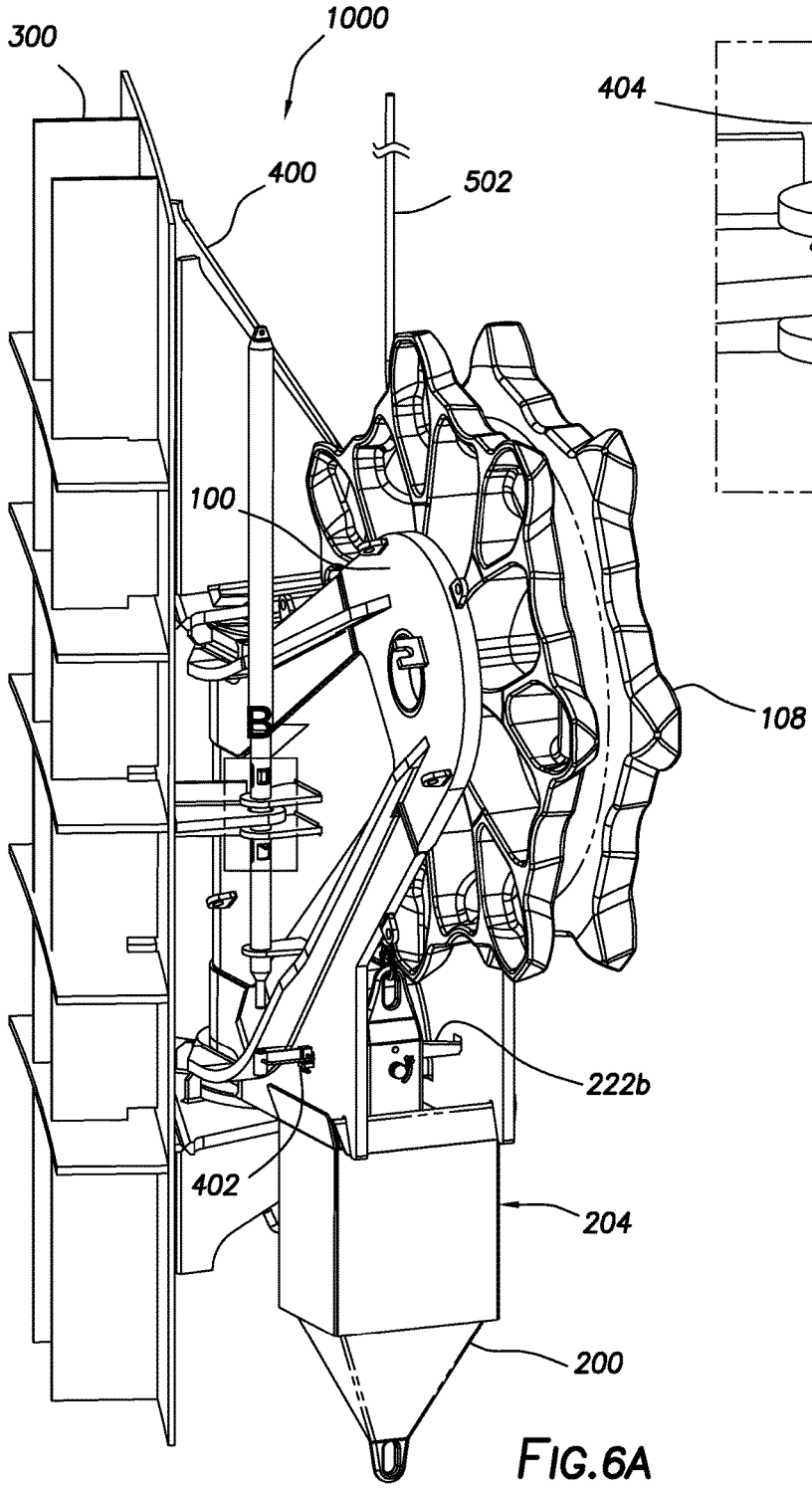
FIGS. 6A and 6B are perspective views of the fairlead and clump weight assembly with the sea-fastening pin released from the toggle interlock in accordance with certain embodiments.
Figure 6B:
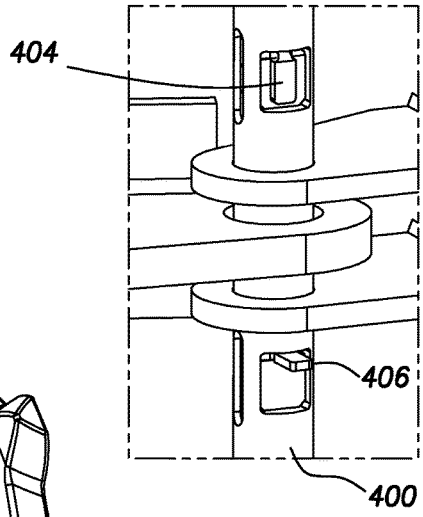

After connection of messenger wire 502 to clump weight chain 220, sea-fastening pin 400 may be removed from engagement with toggle interlock 402. FIGS. 6A and 6B depict fairlead and clump weight assembly 1000 and details thereof with upper sea-fastening pin keeper 404 in an unlocked configuration, and with sea-fastening pin 400 pulled upwards out of engagement with toggle interlock 402. Toggle interlock 402 is still engaged with toggle latch 222*a*. With sea-fastening pin 400 pulled upwards, out of engagement with toggle interlock 402, toggle interlock 402 may be removed from engagement with toggle latch 222*a*, such as via a diver or an ROV.

Figure 7:
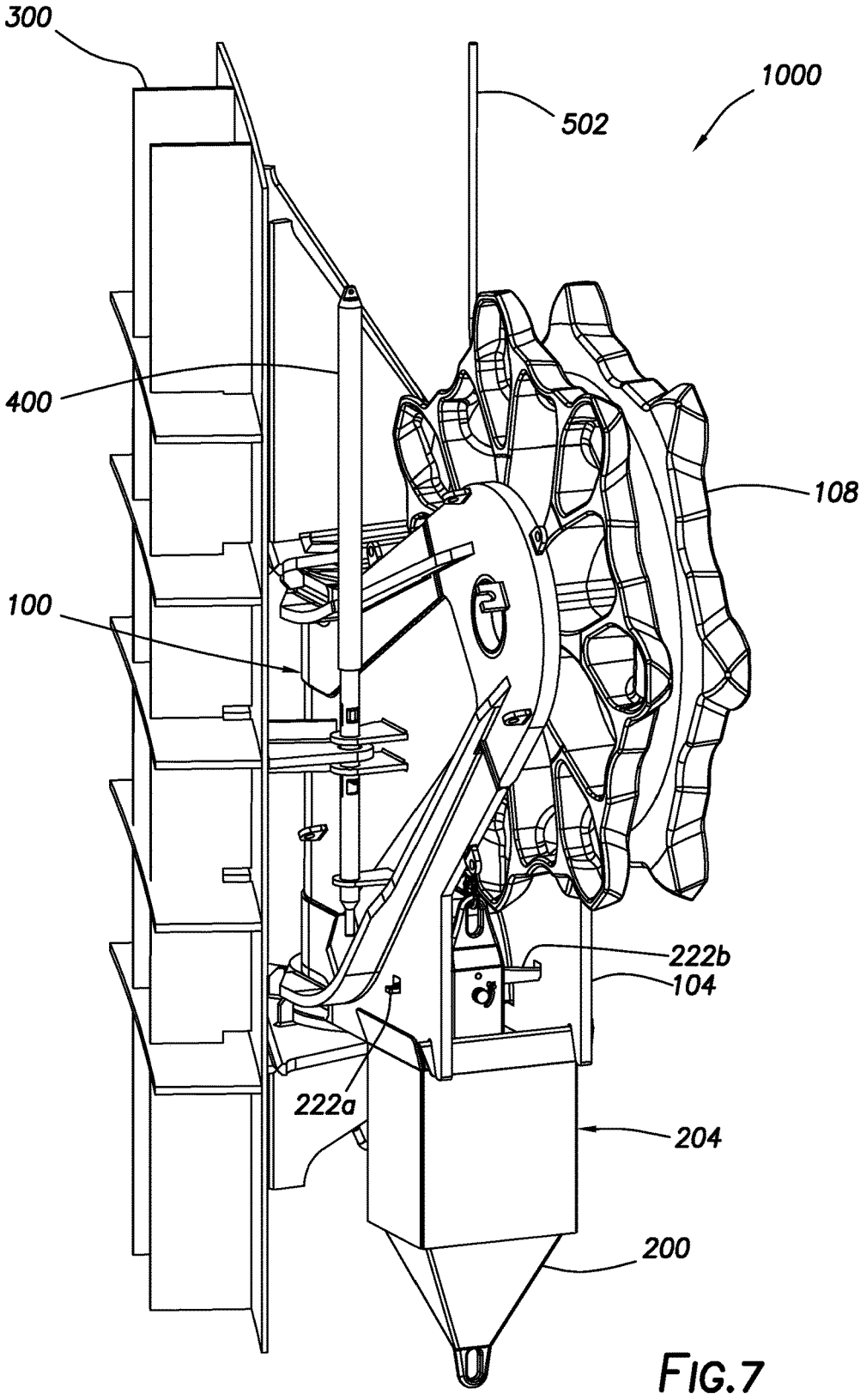
FIG. 7 is a perspective view of the fairlead and clump weight assembly with the toggle interlock released from the toggle latches in accordance with certain embodiments.

After removal of sea-fastening pin 400 from engagement with toggle interlock 402, toggle interlock 402 may be removed from engagement with toggle latch 222*a*, as shown in FIG. 7.

Figure 8:
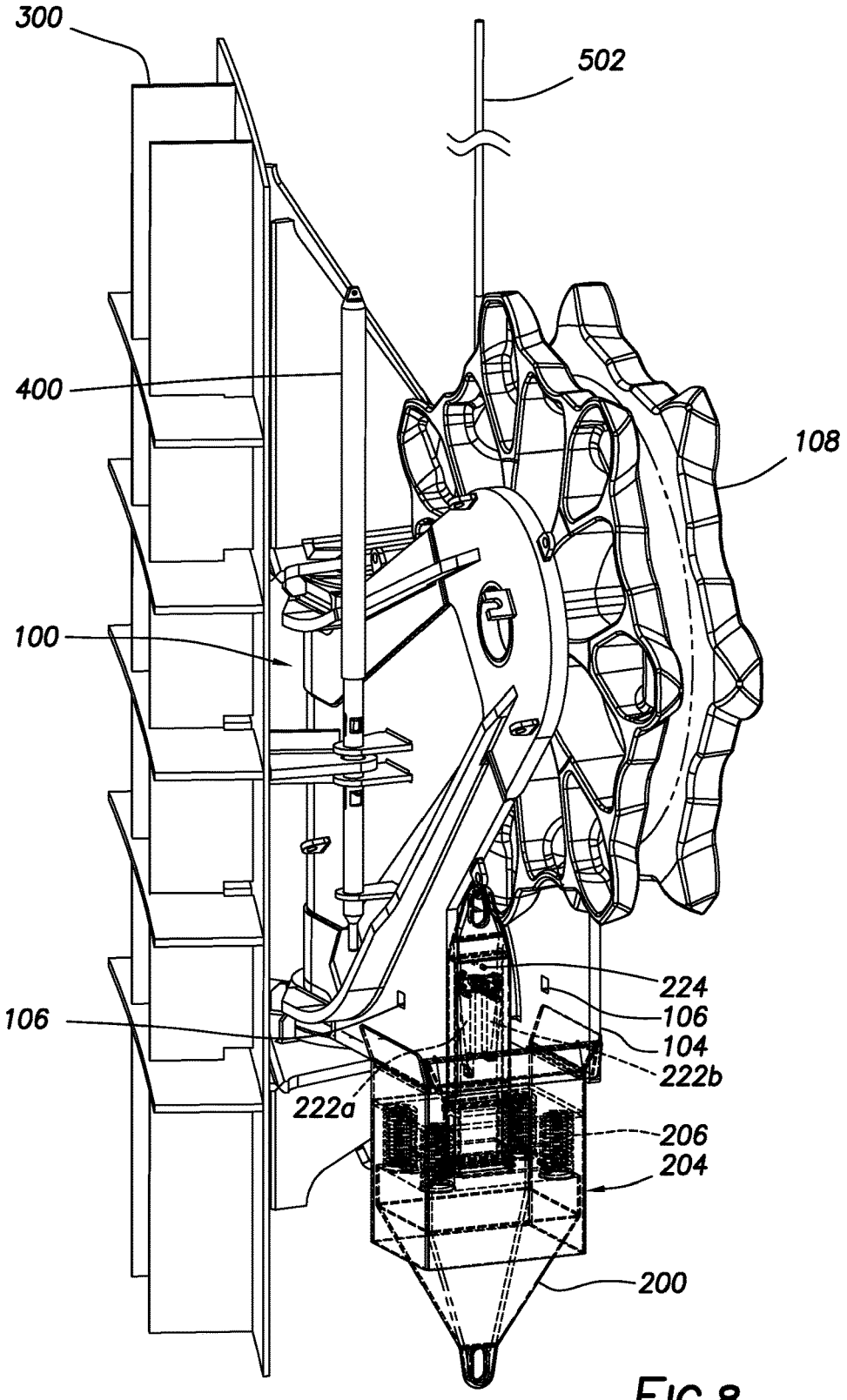
FIG. 8 is a perspective view of the fairlead and clump weight assembly with the clump weight pulled up by the messenger wire to release the toggle latches in accordance with certain embodiments.

After removal of toggle interlock 402 from engagement with both sea-fastening pin 400 and toggle latch 222*a*, clump weight 200 may be pulled upwards via messenger wire 502, as shown in FIG. 8. Messenger wire 502 may be moved by a chain jack, for example. When clump weight 200 is pulled upwards, shear pin 224 is sheared, toggle latches 222*a* and 222*b* are released from engagement within toggle latch eyes 106, and torsion spring 226 biases toggle latches 222*a* and 222*b* downwards. Upon release of toggle latches 222*a* and 222*b* from engagement within toggle latch eyes 106, springs 206 may compress. In some embodiments, upon release of toggle latches 222*a* and 222*b* from engagement within toggle latch eyes 106, springs 206 are compressed to maximum compression. In some embodiments, fairlead and clump weight assembly 1000 is configured such that toggle latches 222*a* and 222*b* cannot be opened without pre-tension applied on messenger wire 502, without sea-fastening pin 400 being released from toggle interlock 402, or combinations thereof.

Figure 9A:
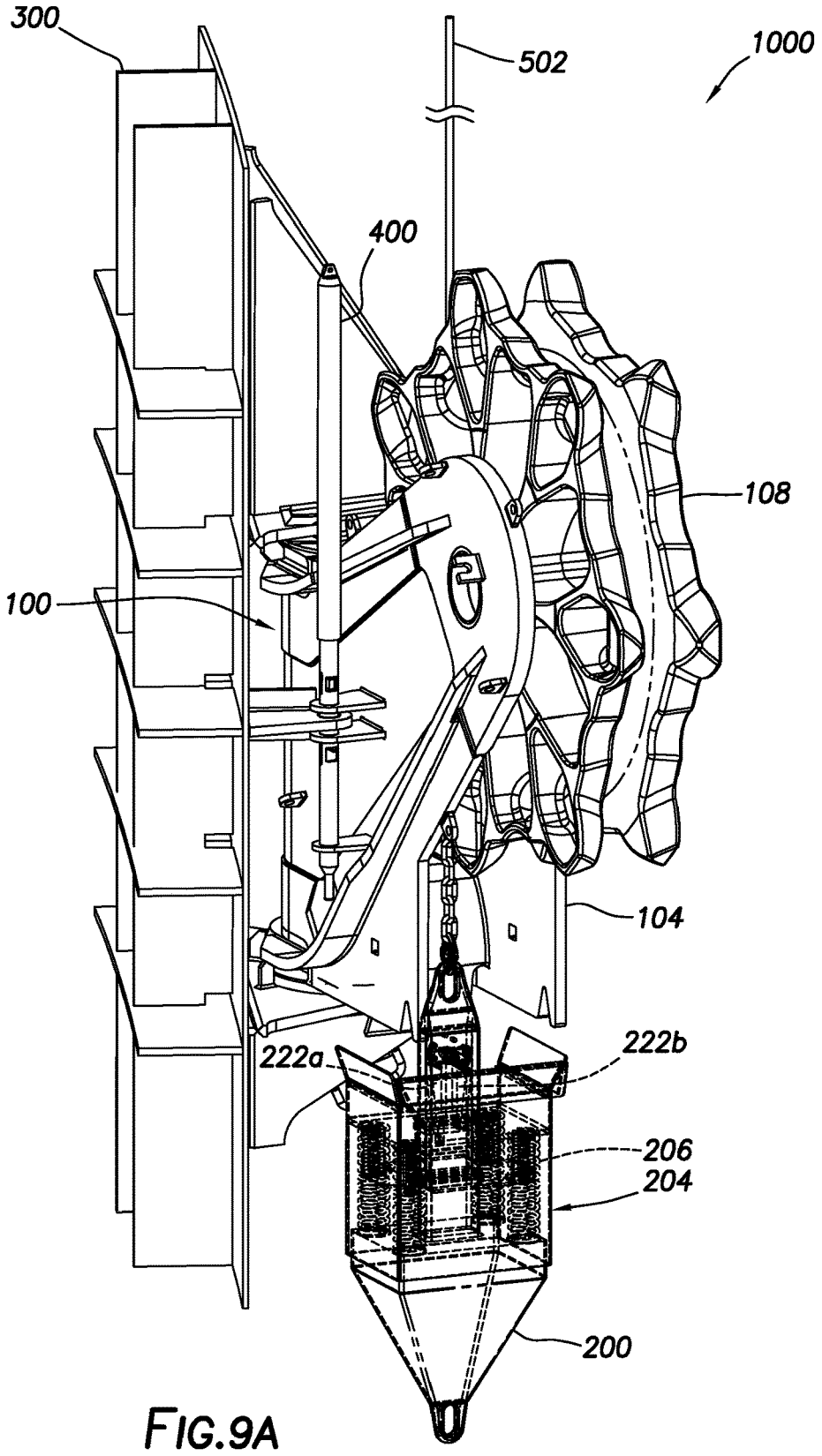
FIG. 9A is a perspective view of the fairlead and clump weight assembly with the clump weight lowered by the messenger wire in accordance with certain embodiments.
Figure 9B:
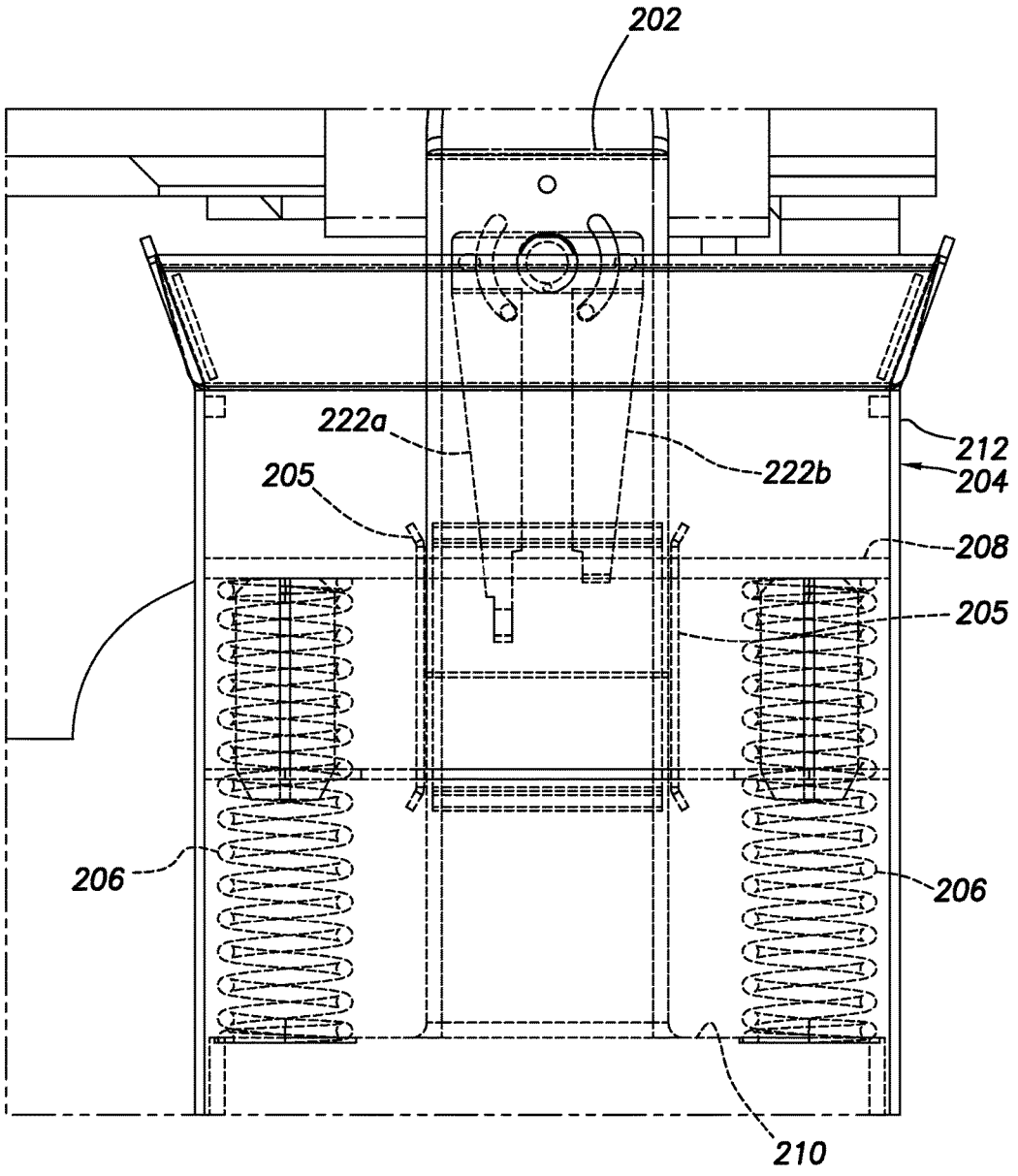
FIG. 9B is a depiction of the spring housing of FIG. 9A, showing the capture of the toggle latches therein in accordance with certain embodiments.

After release of toggle latches 222*a* and 222*b* from engagement within toggle latch eyes 106, clump weight 200 may be lowered by messenger wire 502, as shown in FIG. 9A. When lowering clump weight 200, springs 206 may be uncompressed. As shown in FIG. 9B, released toggle latches 222*a* and 222*b* are captured and contained within inner spring housing 205. Inner spring housing 205 may coupled to or form a portion of spring housing 204. In operation, clump weight 200 provides a counter balance force, allowing a chain jack or other type of mooring line tensioner to pay out messenger wire 502 and any attached anchor chain and anchor, lifting messenger wire 502 and any attached anchor chain and anchor from an inboard locker over chain guide 108 and guiding messenger wire 502 and any attached anchor chain and anchor down to fairlead 100.

In some embodiments, fairlead and clump weight assembly 1000 is configured such that no unplanned releases of clump weight 200 occur, or at least a reduced number of unplanned releases of clump weight 200 occur. For example, in some embodiments, at least three independent actions are required to release clump weight 200 from fairlead 100, including: (1) release of sea-fastening pin 400 from engagement with toggle interlock 402; (2) release of toggle interlock 402 from engagement with toggle latch 222*a*; and (3) raising of clump weight 200 by messenger chain 502 to release toggle latches 222*a* and 222*b* from engagement with toggle latch eyes 106. Fairlead and clump weight 1000 may be configured such that clump weight 200 may be reliably released from fairlead 100 when required. In some embodiments, clump weight 200 may be released from fairlead 100 without getting stuck in engagement with fairlead 100, damaging fairlead 100, rattling while being released from fairlead 100, impacting fairlead 100, becoming wedged into any portion of fairlead 100, scraping any paint off of fairlead 100, or combinations thereof.

Certain embodiments of fairlead and clump weight assembly 1000 may have one or more features that provide failure tolerance thereto, including but not limited to: toggle latches 222*a* and 222*b* configured to not open unless pre-tension is first applied to messenger wire 502; and toggle latches 222*a* and 222*b* configured to not open unless sea-fastening pin 400 is released.

With reference to FIGS. 10A-14C, fairlead and clump weight assembly 2000 and portions thereof are depicted. In FIGS. 10A-14C, like reference numerals relative to those in FIGS. 1-9B are used to designate like elements (e.g., reference numeral "100" indicates fairlead in FIGS. 1-9B, and reference numeral "100*b*" indicates fairlead in FIGS. 10A-14C). Furthermore, as would be understood by those of skill in the art, many attributes of fairlead and clump weight assembly 1000, as discussed above, are equally applicable to fairlead and clump weight assembly 2000.

In the embodiment of FIGS. 10A-14C, clump weight 200*b* and clump weight body 202*b* couple to fairlead 100*b* in a different manner than clump weight 200 and clump weight body 202 couple to fairlead 100, as shown and described with respect to FIGS. 1-9B.

Figure 10B:
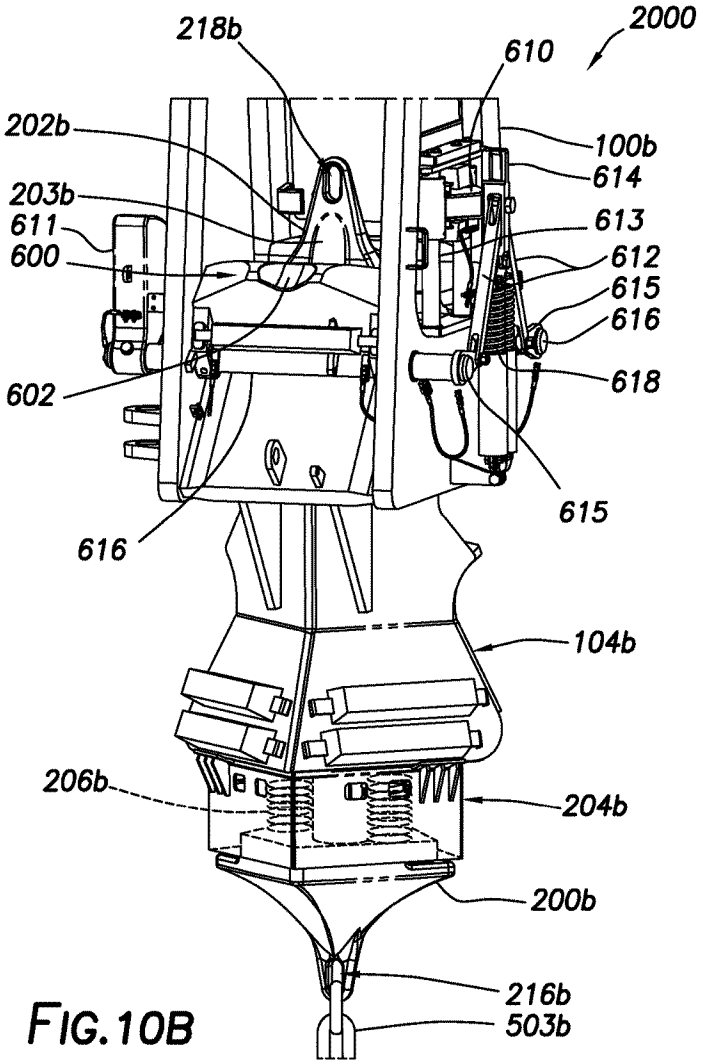
FIGS. 10A and 10B are perspective views of another embodiment of a fairlead and clump weight assembly, and portions thereof.
Figure 12:
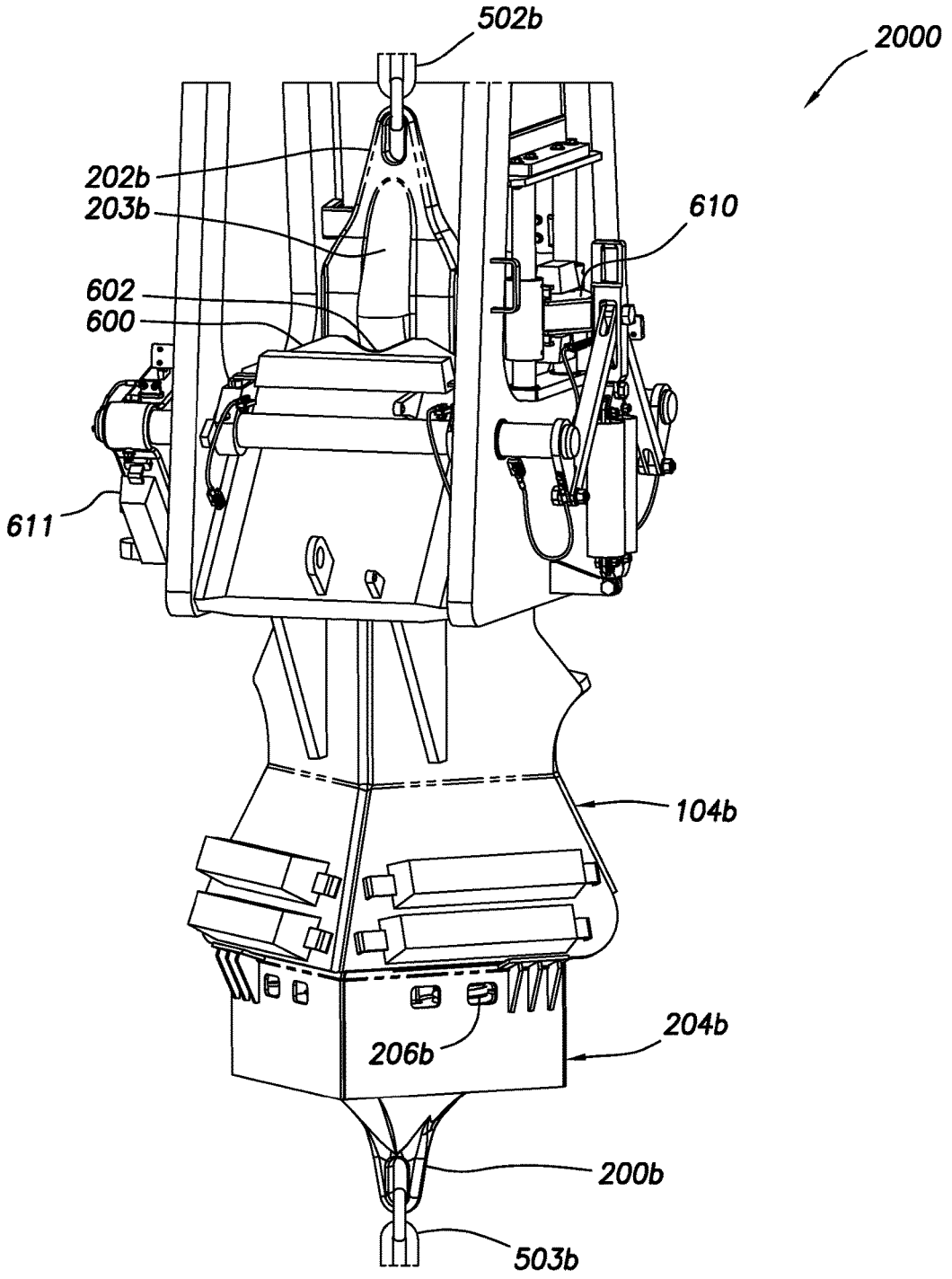
FIG. 12 is a perspective view of the fairlead and clump weight assembly of FIG. 11 with chain latches engaged with a portion of the clump weight.

Fairlead 100*b* includes chain latches 600. Each chain latch 600 has a latch pocket 602, a surface feature configured to engage with a chain (e.g., messenger wire and/or anchor chain). Latch pocket 602 may be a concavity formed on a surface of chain latch 600. Latch pocket 602 may also be configured to engage clump weight body 202*b*. For example and without limitation, clump weight body 202*b* may include one or more surface features 203*b* configured to engage within latch pocket 602. Surface features 203*b* may be a convexity configured to engage within and mate with the concavity of latch pocket 602. Chain latches 600 are configured to selectively move between an open configuration (as shown in FIG. 10B) and a closed configuration (as shown in FIG. 12). In the open configuration, chain latches 600 are open, providing clearance for any chain to pass there-through. Also, in the open configuration, a portion of clump weight body 202*b* may pass between chain latches 600, such that surface features 203*b* are positioned to engage with latch pockets 602 upon closing of chain latches 600 into the closed configuration.

In some embodiments, chain latches 600 are hydraulically controlled to selectively move between the open and closed configurations. In some embodiments, hydraulic actuator 610 is configured to extend and retract along rods 613 to move chain latches 600 between the open and closed configurations. Hydraulic actuator 610 is operatively coupled to latch links 612 via link coupler 614. Latch links 612 are operatively coupled to levers 615, which are in turn operatively coupled to latch pins 616, which are in turn operatively coupled to chain latches 600. Latch coupler 614 is also operatively coupled to latch springs 618, which are in turn operatively coupled to a portion of fairlead 100*b*.

Clump weight 200*b* may include spring engagement members configured to engage with springs 206. For example and without limitation, the spring engagement members may be protrusions, extending vertically from lower housing wall 210*b* (top surface of clump weight 200*b*), configured such that springs 206*b* are slidably engageable about the spring engagement members. In some embodiments, clump weight 200*b* is of sufficient weight to allow a chain jack to lower messenger wire 502*b* and to lift a chain (e.g., anchor chain) from a chain locker on the floating structure. For example and without limitation, clump weight 200*b* may have a weight about five metric tons. Clump weight 200*b* may be installed in drydock before flood, with or without messenger wire 502*b* attached thereto.

Figure 10A:
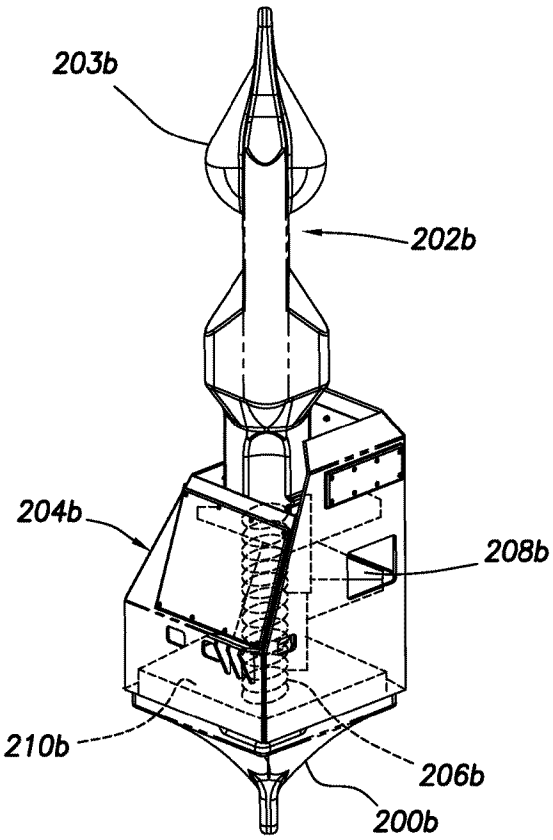

With reference to FIGS. 10A and 10B, to secure clump weight 200*b*, fairlead and clump weight assembly 2000 is placed into an initial configuration, in which: (1) chain latches 600 are open; (2) no preload is placed on messenger wire 502*b* attached to lifting eye 218*b*; and (3) and springs 206*b* are uncompressed. Clump weight body 202*b* is inserted through clump weight engagement member 104*b*, and spring housing 204*b* is engaged with clump weight engagement member 104*b*.

Figure 11:
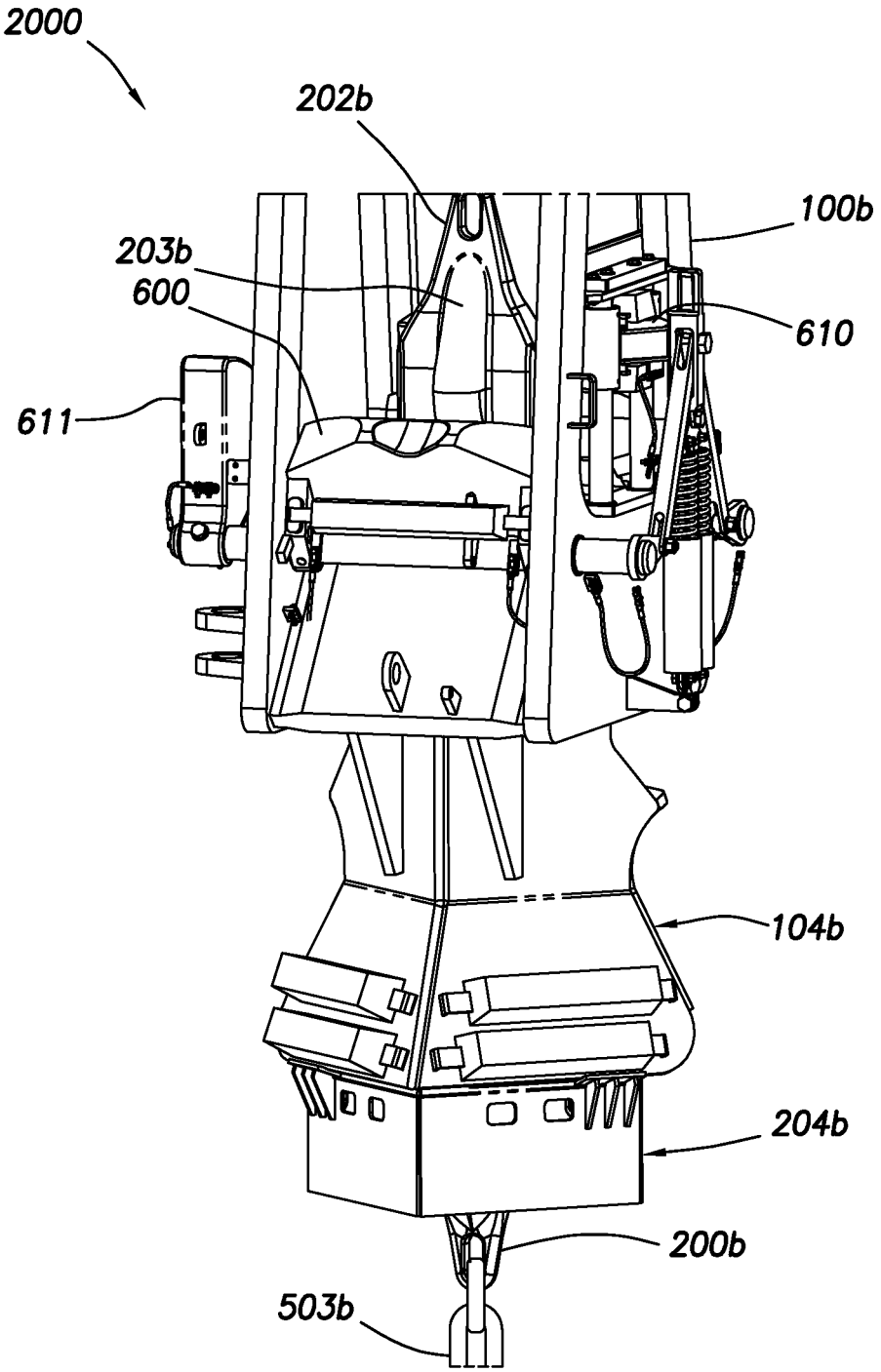
FIG. 11 is a perspective view of the fairlead and clump weight assembly of FIGS. 10A and 10B, with the clump weight pulled upwards.

With reference to FIG. 11, after insertion of clump weight body 202*b* into clump weight engagement member 104*b*, clump weight body 202*b* is extended further into fairlead 100*b*, such as via raising clump weight 200*b* using a messenger wire 502*b*, with chain latches 600 maintained in the open configuration; a preload on the messenger wire 502; and with springs 206*b* compressed. As an example, the preload on the messenger wire 502*b* may be 2 metric tons and the springs 206*b* may be compressed by 300 mm during this operation. One skilled in the art would understand that the magnitudes of load and spring compression are not limited to these particular values, and may vary depending upon the particular application.

With reference to FIG. 12, after extending clump weight 200*b* and clump weight body 202*b*, as shown with reference to FIG. 11, clump weight body 202*b* is secured via chain latches 600. With surface feature 203*b* positioned in operative relation to latch pockets 603, chain latches 600 are closed via latch actuator 610. When chain latches 600 are closed, latch pockets 602 engage with surface features 203*b*, such that chain latches 600 grip and hold a position of clump weight body 202*b*. After closing chain latches 600, the preload on the messenger wire 502*b* may be removed, and the messenger wire 502*b* may be removed. In the configuration shown in FIG. 12, the springs 206*b* within spring housing 204*b* may be compressed. As an example, the springs 206*b* within spring housing 204*b* may be compressed by 150 mm in response to application of a 1 metric ton force. One skilled in the art would understand that the magnitudes of load and spring compression are not limited to these particular values, and may vary depending upon the particular application. Fairlead and clump weight assembly 2000 is shown in a tow configuration in FIG. 12, suitable for towing the floating structure that fairlead and clump weight assembly 2000 is coupled with.

Figure 13:
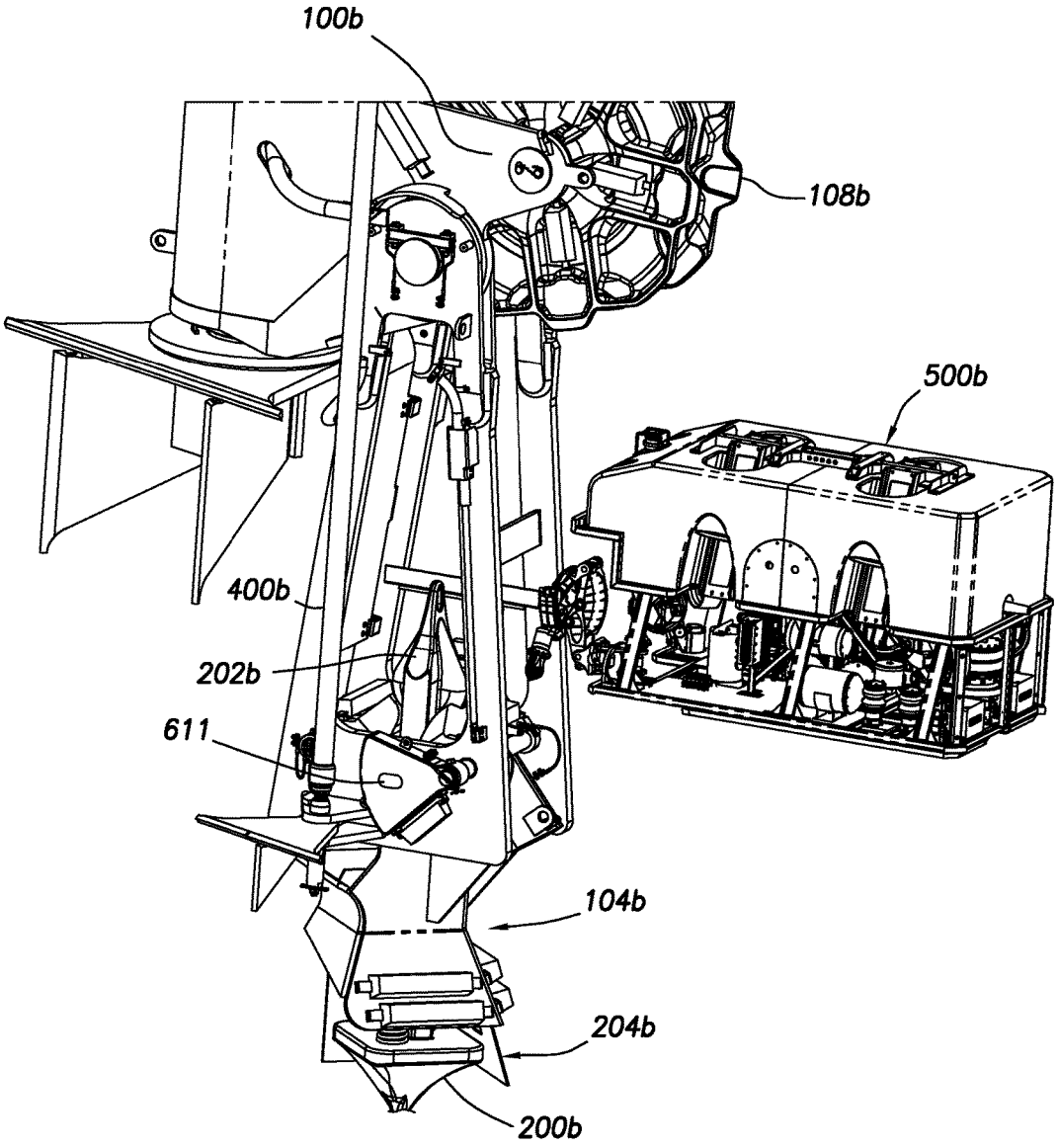
FIG. 13 is a perspective view of the of the fairlead and clump weight assembly of FIGS. 10A and 10B showing a sea-fastening pin thereof and ROV access for routing.

FIG. 13 depicts ROV 500*b*, which may be used to attach a messenger wire (not shown) to clump weight body 202*b*. The steps for release and lowering of clump weight 200*b*, in accordance with certain embodiments, will now be described. Prior to release of clump weight 200*b*: messenger wire 502*b* is attached to clump weight body 202*b* at lifting eye 218*b*; cross-haul wire 503*b* is attached to clump weight 200*b* at lifting eye 216*b*; sea-fastening pin 400*b* is unpinned; and latches 600 are actuated to enter the open configuration, clear of clump weight body 202*b* and the surface feature 603*b* thereof. In some embodiments, release of clump weight 200*b* may be performed in four steps, including: (1) release of sea-fastening pin 400*b*; (2) application of tension to messenger wire 502*b*; (3) opening of latches 600, and holding latches 600 in the open configuration; and (4) lowering of clump weight 200*b*. Rotating chain wheel 108*b* may guide the lowering of clump weight 200*b*. In some embodiments, the tension applied to messenger wire 502*b* may be, for example and without limitation, two metric tons. In certain embodiments, each of step (1)-(4) must be performed, in sequence, in order to release clump weight 200*b*. The requirement of at least four independent actions to release clump weight 200*b* may reduce or prevent the occurrence of unplanned clump weight 200*b* releases. In some embodiments, sea-fastening pin 400*b* locks clump weight engagement member 104*b* to floating structure 300, preventing clump weight engagement member 104*b* from pivoting relative to floating structure 300. In certain embodiments, sea-fastening pin 400*b* engages with latches 600 (e.g., with latch pins) to lock a position of latches 600, such as to lock latches 600 in the opened or closed configuration. In some such embodiments, when sea-fastening pin 400*b* is unpinned, latches 600 are selectively movable between the open and closed configurations. In FIG. 13, a portion of spring housing 204*b* is not shown. In some embodiments, latch structure 611 includes one or more sensors configured to sense a position of latches 600, such as whether or not latches 600 are in the open or closed configuration. In some embodiments, springs 206*b* are compressed sufficiently to apply sufficient pressure onto latches 600 to maintain latches 600 in position (e.g., in the closed configuration). In certain embodiments, latch springs 618 are configured to operate to close latches 600, such as upon the occurrence of hydraulic failure of associated with the latch rods 613 and/or latch actuator 610.

Figure 14B:
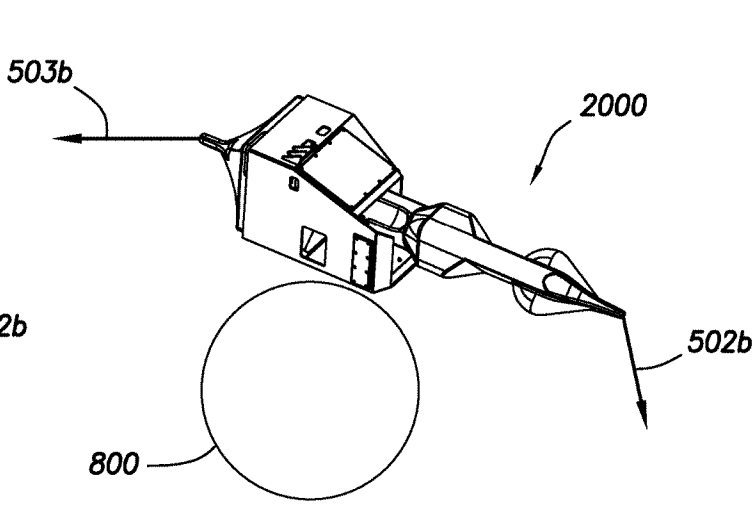
FIGS. 14A-14C are perspective views showing the fairlead and clump weight assembly of FIGS. 10A and 10B passing over a stern roller of a floating structure.
Figure 14A:
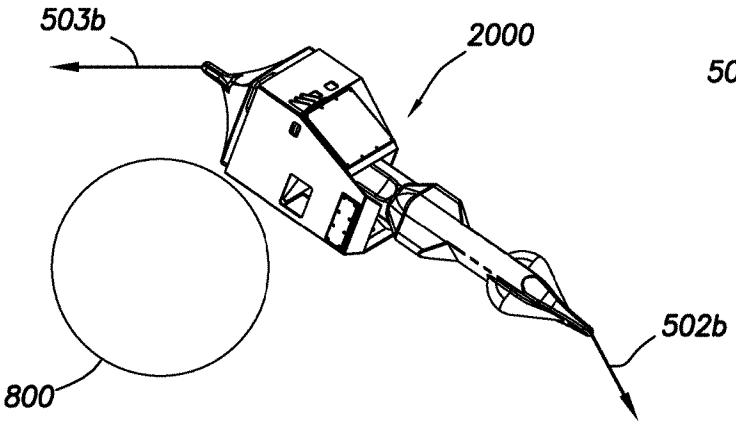
Figure 14C:
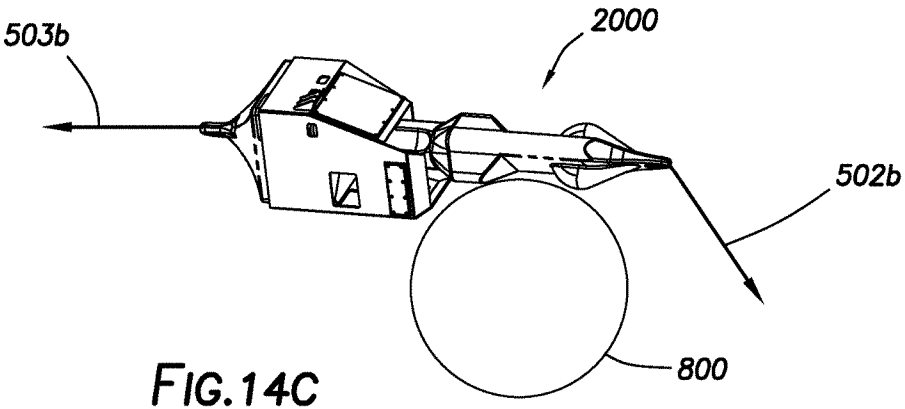

As shown in FIGS. 14A-14C, some embodiments of fairlead and clump weight assembly 2000 have a shape and size configured to allow fairlead and clump weight assembly 2000 to be released from or pulled in over a stern roller 800 of a floating structure. For example and without limitation, a deck winch on the floating structure may be used to pull in cross-haul wire 503*b*.

Fairlead and clump weight assembly 2000 may have one or more features that provide failure tolerance thereto. For example and without limitation, in the case of over-tension on messenger wire 502*b* during tow of the floating structure, or by human error: (1) springs 206*b* may compress (e.g., up to three metric tons); thereby absorbing shock loads, and portions of spring housing 204*b* may contact clump weight 200*b* and stop; and (2) if latches 600 are not in the open configuration and/or not maintained in the open configuration, latches 600 will prevent clump weight 200*b* from falling, thus reducing tension. Additionally, certain embodiments of latches 600 are configured such that latches 600 cannot enter the open configuration: without first applying pre-tension to messenger wire 502*b*; without first releasing sea-fastening pin 400*b*; or combinations thereof. In certain embodiments, the messenger wire 502*b* and cross-haul wire 503*b* load path is a single, solid steel casting. In some embodiments, the strength of springs 206*b* exceeds the minimum breaking load (MBL) of messenger wire 502*b*.

Certain embodiments of the present disclosure include method of installation and use thereof the fairleads, clump weights, and fairlead and clump weight assemblies provided herein.

A first embodiment of such a method (first method) may be implemented, for example and without limitation, using fairlead and clump weight assembly 1000 as depicted in FIGS. 1-9B.

The first method includes installing the clump weight on the fairlead, which may be performed in drydock before submergence of the fairlead, with or without a messenger wire attached thereto.

Installing the clump weight on the fairlead includes: (1) engaging the spring housing with the clump weight engagement member; (2) engaging the toggle latches on the clump weight body within toggle latch eyes of clump weight engagement member; and (3) engaging the sea-fastening pin with the toggle interlock and engaging the toggle interlock with one of the toggle latches.

The first method includes releasing the fairlead and clump weight assembly for towing. The fairlead and clump weight assembly may be released over a stern roller of the floating structure.

The first method includes towing the floating structure to a desired location, with the fairlead and clump weight assembly in the tow configuration.

The first method includes, at the desired location, routing the messenger wire through the fairlead, and connecting the messenger wire with the clump weight (e.g., via the clump weight chain), such as via an ROV or diver.

The first method includes attaching the cross-haul wire from an anchor handling tug to the bottom of the clump weight, such as via an ROV or a diver.

The first method includes releasing the sea-fastening pin from the toggle interlock, and releasing the toggle interlock from the toggle latches.

After removal of the toggle interlock from engagement with both sea-fastening pin and toggle latches, the first method includes pulling the clump weight upwards via the messenger wire at least until the shear pin is sheared, and the toggle latches are released from engagement within the toggle latch eyes.

After release of the toggle latches from engagement within the toggle latch eyes, the first method includes lowering the clump weight using the messenger wire; thereby paying-out the messenger wire and any attached anchor chain and anchor, such as from an inboard locker over the chain guide.

The first method includes recovering the fairlead and clump weight assembly over a stern roller of the floating structure by pulling-in the fairlead and clump weight assembly, such as by using the chain guide and/or deck winch.

A second embodiment of such a method (second method) may be implemented, for example and without limitation, using fairlead and clump weight assembly 2000 as depicted in FIGS. 10A-14C.

The second method includes installing the clump weight on the fairlead, which may be performed in drydock before submergence of the fairlead, with or without a messenger wire attached thereto.

Installing the clump weight on the fairlead includes: (1) engaging the spring housing with the clump weight engagement member; (2) closing the latches of the fairlead at least until the latch pockets engage with the surface features of the clump weight body; and (3) engaging the sea-fastening pin with the chain latches to lock the chain latches into the closed configuration.

The second method includes releasing the fairlead and clump weight assembly for towing. The fairlead and clump weight assembly may be released over a stern roller of the floating structure.

The second method includes towing the floating vessel to a desired location, with the fairlead and clump weight assembly in the tow configuration.

The second method includes, at the desired location, routing the messenger wire through the fairlead, and connecting the messenger wire with the clump weight (e.g., via the clump weight chain), such as via an ROV or diver.

The second method includes attaching the cross-haul wire from an anchor handling tug to the bottom of the clump weight, such as via an ROV or a diver.

The second method includes releasing the sea-fastening pin to unlock the chain latches, applying a pre-tension to the messenger wire, opening the chain latches at least until the latch pockets are no longer engaged with the surface features of the clump weight body, maintaining the chain latches in the open configuration, and lowering the clump weight. The clump weight may be lowered using the messenger wire; thereby paying-out the messenger wire and any attached anchor chain and anchor, such as from an inboard locker over the chain guide.

The second method includes recovering the fairlead and clump weight assembly over a stern roller of the floating structure by pulling-in the fairlead and clump weight assembly, such as by using the chain guide and/or deck winch.

As would be clear to one skilled in the art, with the aid of the present disclosure, some embodiments of the fairlead and clump weight assembly provided herein may be configured to: (1) provide adequate clump weight to pull down on the messenger wire and any topside chain; (2) enable efficient connection of cross-haul cables to the clump weight via ROV or diver without any central processing facility (CPF) topside line handling to minimize vessel time for initial hook-up and tensioning operations; (3) provide a stern roller friendly shape; (4) protect sea-fastening mechanisms (e.g., pins); (5) reliably release the clump weight only when required; (6) be easily installed in drydock (not underwater); (7) survive tows with or without a messenger wire attached, enhancing operational flexibility; (8) substantially reduce risk by installing messenger wires at the end of or late in tow; (9) allow for easy and efficient messenger wire connection to clump weight underwater by divers and/or ROV; (10) reduce or eliminate any further design work, or added vessel weight, structure and equipment that might otherwise be required to handle messenger cable ends routed back to the topsides; (11) reduce or eliminate any requirement for significant preload on the messenger wires during the tow; thereby reducing stresses and risks in the mooring system; or (12) combinations thereof.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A fairlead and clump weight assembly comprising:

a fairlead, the fairlead including a chain guide support structure and a clump weight engagement member;

a clump weight assembly, the clump weight assembly including a clump weight body, a clump weight coupled to the clump weight body, and a spring housing, wherein at least one spring is coupled between the spring housing and the clump weight; and wherein the clump weight body is selectively engageable and disengageable with the fairlead.

2. The fairlead and clump weight assembly of claim 1, wherein a chain guide is coupled to the chain guide support structure.

3. The fairlead and clump weight assembly of claim 1, wherein the spring housing includes an upper housing wall, and wherein the at least one spring coupled between the spring housing and the clump weight is coupled between the upper housing wall and the clump weight.

4. The fairlead and clump weight assembly of claim 3, wherein the clump weight is movable relative to the spring housing, and each spring is configured to compress when the clump weight moves towards the upper housing wall.

5. The fairlead and clump weight assembly of claim 1, wherein a bottom of the clump weight engagement member is shaped to engage with a top of the spring housing.

6. The fairlead and clump weight assembly of claim 1, wherein the clump weight body is selectively engageable and disengageable with the fairlead via latches.

7. The fairlead and clump weight assembly of claim 6, wherein the fairlead includes at least one toggle latch eye on the fairlead, wherein the latches include at least one toggle latch that is movably coupled to the clump weight body, and wherein each toggle latch is selectively engageable and disengageable with one of the at least one toggle latch eyes.

8. The fairlead and clump weight assembly of claim 7, further comprising a shear pin engaged to each toggle latch, wherein the shear pin is configured to limit movement of each toggle latch relative to the clump weight body, and wherein each toggle latch is configured to move relative to the clump weight body when the shear pin is sheared or removed.

9. The fairlead and clump weight assembly of claim 7, wherein, when each toggle latch is engaged within one of the at least one toggle latch eyes, the clump weight is secured in position under a spring tension.

10. The fairlead and clump weight assembly of claim 7, further comprising a sea-fastening pin movably coupled to the fairlead, the sea-fastening pin configured to selectively couple to the at least one toggle latch when the at least one toggle latch is engaged within the at least one toggle latch eye.

11. The fairlead and clump weight assembly of claim 7, wherein each toggle latch is selectively movable between an open configuration and a closed configuration, wherein in the open configuration each toggle latch is engaged with one of the at least one toggle latch eyes, and wherein in the closed configuration each toggle latch is captured and contained within the spring housing.

12. The fairlead and clump weight assembly of claim 7, further comprising:

a shear pin engaged to each toggle latch, wherein the shear pin is configured to limit movement of each toggle latch relative to the clump weight body; and a sea-fastening pin movably coupled to the fairlead, the sea-fastening pin configured to selectively couple to the at least one toggle latch when the at least one toggle latch is engaged within the at least one toggle latch eye, wherein the sea-fastening pin is operatively coupled to the at least one toggle latch via a toggle interlock;

wherein at least three independent actions are required to release the clump weight from the fairlead, the at least three independent actions including: (1) release of the sea-fastening pin from engagement with the toggle interlock; (2) release of the toggle interlock from engagement with the at least one toggle latch; and (3) raising of the clump weight by a messenger chain coupled thereto to release the each toggle latch from engagement with each toggle latch eye.

13. The fairlead and clump weight assembly of claim 1, wherein the fairlead comprises a chain latch, the chain latch selectively engageable and disengageable to the clump weight body.

14. The fairlead and clump weight assembly of claim 13, wherein the chain latch comprises a latch pocket, wherein the clump weight body comprise a surface feature, the surface feature configured to mate with the latch pocket.

15. The fairlead and clump weight assembly of claim 13, wherein the chain latch is selectively movable between an open configuration and a closed configuration, wherein in the open configuration the chain latch is disengaged from the clump weight body, and wherein in the closed configuration the chain latch grips and supports the clump weight body.

16. The fairlead and clump weight assembly of claim 15, further comprising a sea-fastening pin coupled to the fairlead and selectively engageable with the chain latch, wherein, when the sea-fastening pin is engaged with the chain latch, the chain latch is locked in the closed configuration, wherein at least four independent actions are required to release the clump weight from the fairlead, the at least four independent actions including: (1) release of the sea-fastening pin to unlock the chain latch; (2) application of tension to a messenger wire coupled to the clump weight body; (3) opening of the chain latches, and holding the chain latches in the open configuration; and (4) lowering of the clump weight.

17. A method of installation and use of a clump weight, the method comprising:

providing a fairlead on a floating structure, the fairlead including a chain guide support structure and a clump weight engagement member;

providing a clump weight assembly, the clump weight assembly including a clump weight body, a clump weight coupled to the clump weight body, and a spring housing, wherein at least one spring is coupled between the spring housing and the clump weight; and installing the clump weight assembly on the fairlead, wherein installing the clump weight assembly on the fairlead includes engaging the spring housing with the clump weight engagement member, and latching the clump weight body to the clump weight engagement member.

18. A fairlead and clump weight assembly comprising:

a fairlead;

a clump weight assembly, the clump weight assembly including a clump weight and a spring housing, wherein at least one spring is coupled between the spring housing and the clump weight;

wherein the clump weight is selectively engageable and disengageable with the fairlead.

19. The fairlead and clump weight assembly of claim 18, wherein the fairlead includes at least one toggle latch eye, wherein at least one toggle latch is movably coupled to the clump weight, and wherein the clump weight is selectively engageable and disengageable with the fairlead via selectively engaging and disengaging the toggle latches with the toggle latch eyes.

20. The fairlead and clump weight assembly of claim 18, wherein the fairlead comprises a chain latch, and wherein the clump weight is selectively engageable and disengageable with the fairlead via selectively engaging and disengaging the chain latch to the clump weight.

21. The fairlead and clump weight assembly of claim 18, wherein the spring housing is engaged with a clump weight engagement member of the fairlead.

22. The fairlead and clump weight assembly of claim 18, wherein the clump weight is selectively engageable and disengageable with the fairlead via latches.

23. The fairlead and clump weight assembly of claim 18, wherein the spring housing is engaged with the fairlead, and wherein the clump weight is latched via latches to the fairlead and is suspended from the spring housing via the at least one spring.

24. The fairlead and clump weight assembly of claim 23, wherein the fairlead is coupled on a vessel, and wherein the latches are coupled with the vessel via a sea-fastening pin.

25. A clump weight assembly comprising:

a clump weight;

a spring housing; and at least one spring is coupled between the spring housing and the clump weight;

wherein the spring housing and clump weight are configured to couple with a fairlead such that the clump weight is suspended from the spring housing via the at least one spring.

* * * * *